US009434499B2

(12) United States Patent
Boulay et al.

(10) Patent No.: US 9,434,499 B2
(45) Date of Patent: Sep. 6, 2016

(54) CONTAINERS HAVING IMPROVED VACUUM RESISTANCE

(71) Applicant: NESTEC S.A., Vevey (CH)

(72) Inventors: Cedric Boulay, Bulgneville (FR); Nicolas Dabrowski, Vittel (FR); Seung-Yeol Hong, Dublin, OH (US); Jean-Francois Meyer, Vittel (FR); Lise Zeboudj, Columbus, OH (US)

(73) Assignee: Nestec S.A., Vevey (CH)

( * ) Notice: Subject to any disclaimer, the term of this patent is extended or adjusted under 35 U.S.C. 154(b) by 0 days.

(21) Appl. No.: 14/397,794

(22) PCT Filed: Apr. 11, 2013

(86) PCT No.: PCT/EP2013/057547

§ 371 (c)(1),
(2) Date: Oct. 29, 2014

(87) PCT Pub. No.: WO2013/164170

PCT Pub. Date: Nov. 7, 2013

(65) Prior Publication Data

US 2015/0108081 A1 Apr. 23, 2015

Related U.S. Application Data

(60) Provisional application No. 61/640,079, filed on Apr. 30, 2012.

(51) Int. Cl.

| | |
|---|---|
| ***B65D 1/02*** | (2006.01) |
| ***B65D 79/00*** | (2006.01) |
| ***B65D 1/44*** | (2006.01) |

(52) U.S. Cl.

CPC ..... *B65D 1/0284* (2013.01); *B65D 1/0223* (2013.01); *B65D 1/44* (2013.01); *B65D 79/005* (2013.01); *B65D 2501/0036* (2013.01); *B65D 2501/0081* (2013.01)

(58) Field of Classification Search

CPC .... B65D 90/02; B65D 23/10; B65D 1/0284; B65D 79/005

USPC ..... 215/383, 379, 381, 382, 385, 398; 220/672, 771

See application file for complete search history.

(56) References Cited

U.S. PATENT DOCUMENTS

| | | | | |
|---|---|---|---|---|
| 7,097,059 | B2 * | 8/2006 | Saito et al. | 215/383 |
| 8,069,986 | B2 * | 12/2011 | Darr | B65D 1/0276 206/509 |
| 8,091,720 | B2 * | 1/2012 | Colloud | B65D 1/0223 215/384 |

(Continued)

FOREIGN PATENT DOCUMENTS

| | | |
|---|---|---|
| EP | 1386844 | 2/2004 |

*Primary Examiner* — Anthony Stashick
*Assistant Examiner* — Raven Collins
(74) *Attorney, Agent, or Firm* — K&L Gates LLP

(57) ABSTRACT

Containers having improved vacuum-resistance and aesthetic features are provided. In a general embodiment, the present disclosure provides a container (10) having a substantially rectangular-shaped body including at least one cut-away portion (32) on a first side of the body. The cut-away portion includes a panel (34) that is intersected by a horizontal rib (36) that extends along an outer perimeter of the container in a substantially horizontal plane. The structural features of the present containers advantageously provide for improved vacuum-resistance and consumer gripping when compared to similar containers currently on the market.

20 Claims, 2 Drawing Sheets

(56) References Cited

U.S. PATENT DOCUMENTS 8,813,996 B2 * 8/2014 Steih et al. ..... 220/675
2001/0054597 A1 12/2001 Ozawa et al.
2010/0000962 A1 * 1/2010 Lepoitevin et al. ..... 215/381
2010/0000963 A1 * 1/2010 Inomata et al. ..... 215/383
2010/0326951 A1 12/2010 Coley, Jr. et al.
2012/0312826 A1 * 12/2012 Yourist ..... 220/669

* cited by examiner

CONTAINERS HAVING IMPROVED VACUUM RESISTANCE

CROSS REFERENCE TO RELATED APPLICATIONS

The present application is a National Stage of International Application No. PCT/EP2013/057547, filed on Apr. 11, 2013, which claims priority to U.S. Provisional Patent Application No. 61/640,079, filed Apr. 30, 2012, the entire contents of which are being incorporated herein by reference.

BACKGROUND

The present disclosure generally relates to containers. More specifically, the present disclosure relates to lightweight containers having improved vacuum resistance capacities and improved aesthetics.

Currently, the market comprises many different shapes and sizes of containers capable of housing fluids. The shape and size of fluid containers can depend, among other things, on the amount of fluid to be housed, the type of fluid to be housed, consumer demands and desired aesthetics. For example, toxic fluids may be required to be housed in containers that have thicker walls and a more rigid structure. More often than not, the market for these types of fluids is determined by safety of the containers more so than that container's aesthetics. On the contrary, consumable fluids such as water may be housed in containers that generally have thinner walls and a less rigid structure. Indeed, the market for consumable fluids may be determined by the aesthetics desired by the consumer instead of safety requirements.

Regardless of the specific size and shape of a container, the container should be able to withstand different environmental factors encountered during, for example, manufacturing, shipping and retail shelf stocking or storage. One example of such an environmental factor includes oxygen absorption into the product housed in the container. In this regard, certain liquid consumer products are susceptible to absorption of oxygen that is present in the headspace of the container and/or oxygen that ingresses from the outside environment. This oxygen absorption can create a vacuum inside the container that can attribute to deformation of the bottle, resulting in poor overall aesthetics. Accordingly, a need exists for a lightweight fluid container having improved structural features as well as desirable aesthetic characteristics.

SUMMARY

The present disclosure relates to lightweight, vacuum-resistant containers for housing liquid products. In a general embodiment, the present disclosure provides a plastic container including a substantially rectangular-shaped body having at least one cut-away portion on a first side of the body, the cut-away portion having a panel that is intersected by a horizontal rib that extends along an outer perimeter of the container in a substantially horizontal plane.

In an embodiment, the panel has two complimentary shaped indentations formed on either side of the intersecting horizontal rib.

In an embodiment, the intersecting horizontal rib is curved at a location where it intersects the panel. In such an embodiment, the panel may include two complimentary bean-shaped portions formed by the intersecting curved horizontal rib.

In an embodiment, the intersecting horizontal rib is one of an interrupted rib and a fully circumferential rib.

In an embodiment, the body further includes a second panel on a second side of the body, wherein the second panel is located in the same horizontal plane as the first panel.

In an embodiment, the container further includes a mouth and a shoulder between the mouth and the body. The shoulder has four faces arranged in a square pyramid frustum shape, and at least one of the four faces includes a cut-away portion having a panel intersected by an interrupted horizontal rib.

In an embodiment, the first side includes a plurality of the cut-away portions.

In an embodiment, the container has a volume ranging from about 100 mL to about 5000 mL.

In another embodiment, a plastic container is provided and includes a neck defining a mouth of the container, and a body having a plurality of horizontal ribs extending along an outer perimeter of the container. Each rib is located in a different horizontal plane, and at least one of the horizontal ribs is located intermediate two complimentary-shaped indentations.

In an embodiment, each of the plurality of horizontal ribs is a fully circumferential horizontal rib.

In an embodiment, every other horizontal rib is located intermediate two complimentary-shaped indentations.

In an embodiment, the complimentary-shaped indentations are bean-shaped panels.

In an embodiment, the body includes four sides and each side has a plurality of horizontal ribs located intermediate two complimentary-shaped indentations.

In an embodiment, the body includes at least one wall having first and second opposing inwardly-sloped portions forming an elongated middle section of the container. The elongated middle portion of the container may have a reduced cross-section compared to vertical portions of the container.

In an embodiment, the first and second opposing inwardly-sloped portions meet at a horizontal rib.

In an embodiment, the container has a weight ranging from about 23 g to about 27 g.

In yet another embodiment, a plastic container is provided and includes a neck that defines a mouth of the container, and a substantially rectangular shaped body. The body has a first plurality of horizontal ribs extending along an outer perimeter of the container, and a second plurality of horizontal ribs extending along an outer perimeter of the container. Each rib of the first plurality of horizontal ribs is located in a different horizontal plane, and each rib of the second plurality of horizontal ribs is located in a different horizontal plane and located intermediate two complimentary-shaped indentations. Each of the ribs in the first plurality of horizontal ribs alternates in a vertical direction with each of the ribs in the second plurality of horizontal ribs.

In an embodiment, each of the ribs in the first plurality of horizontal ribs has a greater height than each of the ribs in the second plurality of horizontal ribs.

An advantage of the present disclosure is to provide an improved container.

Another advantage of the present disclosure is to provide a lightweight container that resists vacuum deformation.

Still another advantage of the present disclosure is to provide a container having improved vacuum-resistance features.

Yet another advantage of the present disclosure is to provide a container having improved aesthetics.

Another advantage of the present disclosure is to provide a container that is constructed and arranged for easy handling by a consumer.

Additional features and advantages are described herein, and will be apparent from the following Detailed Description and the figures.

DETAILED DESCRIPTION

Figure 1:
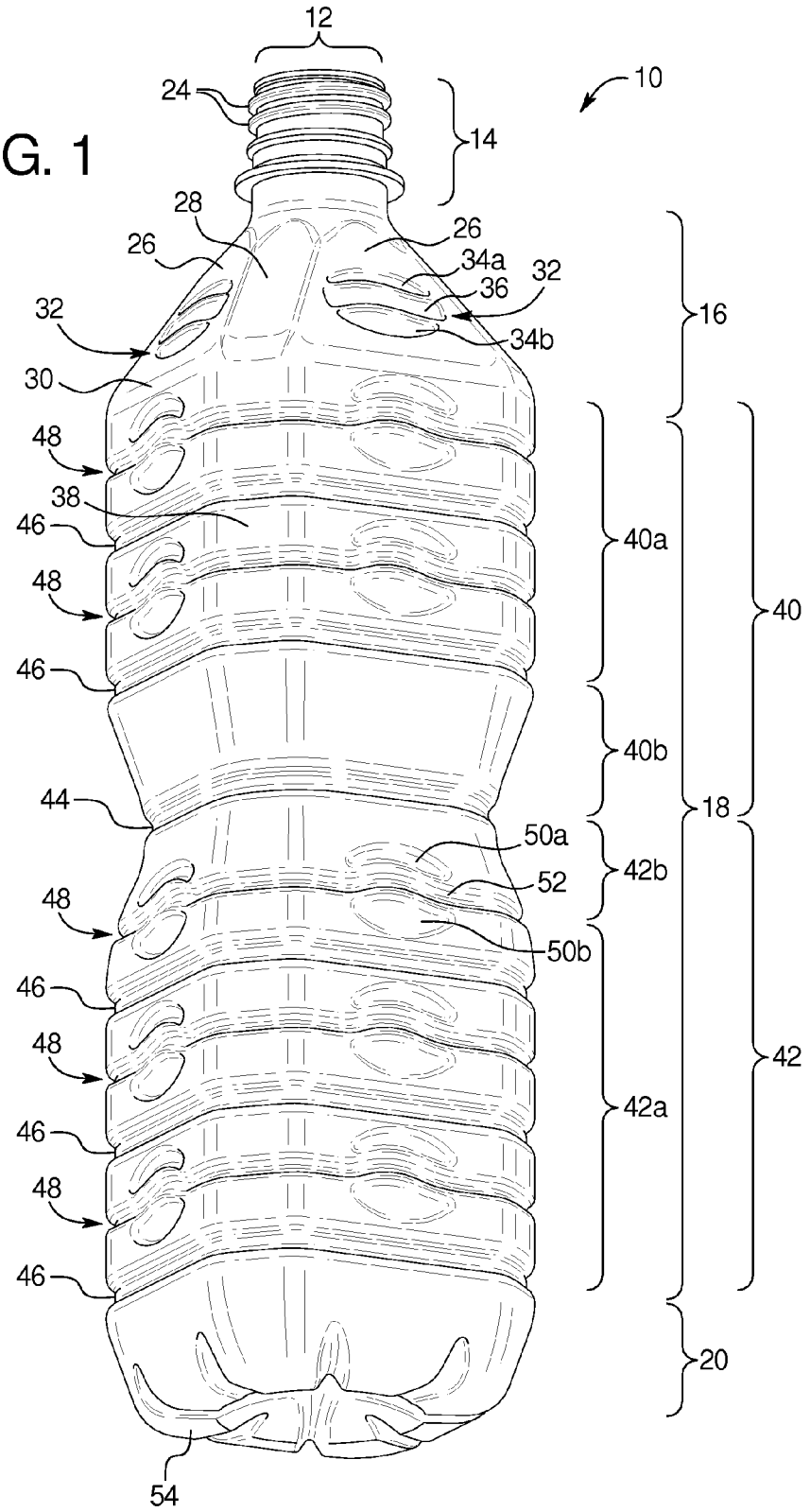
FIG. 1 shows a perspective view of a container in an embodiment of the present disclosure.

The present disclosure relates to lightweight, vacuum-resistant bottles and/or containers for providing consumable products and other fluids. The bottles are constructed and arranged to be vacuum resistant to provide a lightweight bottle having not only improved structural features, but also improved aesthetics.

It is known that many liquid consumable products are oxygen sensitive. This becomes increasing relevant, for example, when the liquid consumable products are shelf-stable and may spend an amount of time sitting on a retail shelf. During the shelf-life of a product, oxygen may be absorbed by the product from the headspace in the container or from the outside environment that permeates through the container walls. Such oxygen absorption can induce a vacuum inside the bottle that causes the bottle to deform. Similarly, during packaging, distribution and retail stocking, bottles can be exposed to widely varying temperature and pressure changes (e.g., bottle contraction in the refrigerator), liquid losses, and external forces that jostle and shake the bottle. If, for example, the bottles contain carbonated fluids, these types of environmental factors can contribute to internal pressures or vacuums that affect the overall quality of the product purchased by the consumer. For example, existing types of vacuum panels, or thin plastic labels, can occupy large areas of the exterior of the bottle to which they are added and tend to have great visual impact. When an internal vacuum is created within the bottle, the shrink sleeve labels do not always follow the slightly inverted shape of the bottle created by the vacuum, thereby accounting for poor aesthetics of the bottle.

Applicants do not believe that any product currently exists on the market that provides a lightweight plastic container (e.g., polyethylene terepthalate) having an improved product sleeve appearance as a result of increased vacuum resistance from modified ribs or indentations in the container. Indeed, containers with fully circumferential, horizontal ribs must increase the rib dimensions to create a lightweight container. As such, the ribs are more visible to the consumer, which provides for less than optimal aesthetic properties. Further, providing panels on the containers provides a more visually appealing container, but requires more plastic material, which creates a heavier container.

In contrast, Applicants have surprisingly discovered how to provide a lightweight container that resists internal vacuums. In this regard, containers of the present disclosure include features that help to avoid bottle deformation that would cause loss of stability of the container and the potential perception of the consumer that the container has a defect and is not suitable for purchase. For example, containers of the present disclosure may include interrupted panels having an intersecting, curved, horizontal rib. Containers of the present disclosure may also include a smaller section in the middle of the bottle and high drafted corners.

As mentioned previously, containers of the present disclosure may be used to house carbonated liquids, or may be exposed to temperature and/or pressure changes during packaging, shipping, storage and/or retail display. Any of the above-described factors (e.g., carbonation, temperature changes, pressure changes, oxygen absorption, etc.) can contribute to the presence of an internal vacuum within a sealed container when the container houses a liquid. This is problematic for aesthetic reasons because internal vacuums created within the sealed container can cause deformation of the container that can pull the walls of the container away from any exterior label (e.g., sleeve), creating an undesirable aesthetic. Applicants have surprisingly found, however, that certain structural features can help to improve a container's vacuum resistance to avoid undesired container deformation.

As used herein, and as would be immediately appreciated by the skilled artisan, a container "sleeve" is a thin, plastic film that may include indicia thereon and is typically used in the marketplace for product identification and for displaying product information.

As illustrated in FIG. 1, in an embodiment, the present disclosure provides a container, or bottle, 10 having a mouth 12, a neck 14, a shoulder 16, a body 18, and a base 20. Container 10 may be sized to hold any suitable volume of a liquid such as, for example, from about 50 to 5000 mL including 100 mL, 200 mL, 300 mL, 400 mL, 500 mL, 600 mL, 700 mL, 800 mL, 900 mL, 1000 mL, 1500 mL, 2000 mL, 2500 mL, 3000 mL, 3500 mL, 4000 mL, 4500 mL and the like. In an embodiment, container 10 has a volume of about 900 mL.

As disclosed above, containers of the present disclosure are lightweight containers. In this regard, the containers of the present disclosure may require from about 10% to about 25% less material to manufacture than similar containers not having the features described herein. The containers of the present disclosure may have a weight ranging from about 10 g to about 40 g, or from about 15 g to about 35 g, or from about 20 g to about 30 g, or about 25 g or 27 g.

Containers of the present disclosure may be configured to house any type of liquid therein. In an embodiment, the containers are configured to house a consumable liquid such as, for example, water, an energy drink, a carbonated drink, tea, coffee, etc. In an embodiment, the containers are sized and configured to house a carbonated beverage.

Suitable materials for manufacturing containers of the present disclosure can include, for example, polymeric materials. Specifically, materials for manufacturing bottles of the present disclosure can include, but are not limited to, polyethylene ("PE"), low density polyethylene ("LDPE"), high density polyethylene ("HDPE"), polypropylene ("PP") or polyethylene terephthalate ("PET"). Further, the containers of the present disclosure can be manufactured using any suitable manufacturing process such as, for example, conventional extrusion blow molding, stretch blow molding, injection stretch blow molding, and the like.

Mouth 12 may be any size and shape known in the art so long as liquid may be introduced into container 10 and may be poured or otherwise removed from container 10. In an embodiment, mouth 12 may be substantially circular in shape and have a diameter ranging from about 10 mm to about 50 mm, or about 15 mm, 20 mm, 25 mm, 30 mm, 35 mm, 40 mm, 45 mm, or the like. In an embodiment, mouth 12 has a diameter that is about 33 mm.

Neck 14 may also have any size and shape known in the art so long as liquid may be introduced into container 10 and may be poured or otherwise removed from container 10. In an embodiment, neck 14 is substantially cylindrical in shape having a diameter that corresponds to a diameter of mouth 12. Alternatively, neck 14 may have a tapered geometry such that neck 14 is substantially conical in shape and tapers up to mouth 12. The skilled artisan will appreciate that the shape and size of neck 14 are not limited to the shape and size of mouth 12. Neck 14 may have a height (from mouth 12 to shoulder 16) from about 5 mm to about 45 mm, or about 10 mm, 15 mm, 20 mm, 25 mm, 30 mm, 35 mm, 40 mm, or the like. In an embodiment, neck 14 has a height of about 25 mm.

Figure 2:
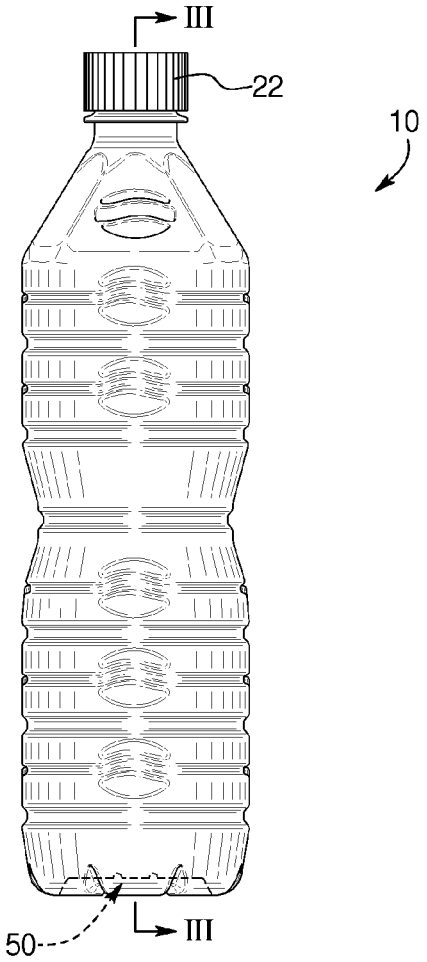
FIG. 2 shows a side view of a container in an embodiment of the present disclosure.

Container 10 can further include an air tight cap 22 attached to neck 14, as shown in FIG. 2. Cap 22 can be any type of cap known in the art for use with containers similar to those described herein. Cap 22 may be manufactured from the same or a different type of polymeric material as container 10, and may be attached to container 10 by re-closeable threads, or may be snap-fit, friction-fit, etc. Accordingly, in an embodiment, cap 22 includes internal threads (not shown) that are constructed and arranged to mate with external threads 24 of neck 14.

Shoulder 16 of container 10 in FIG. 1 extends from a bottom portion of neck 14 downward to a top portion of body 18. In an embodiment wherein container 10 is substantially square or rectangular in shape, shoulder 16 comprises a shape that is substantially a square pyramid frustum. As used herein, a "square pyramid frustum" means that shoulder 16 has a shape that very closely resembles a square pyramid having four triangular faces and one imaginary square face (not shown) at a base of the square pyramid, and having a top portion (e.g., the apex) of the square pyramid lopped-off. Shoulder 16 has a lopped-off apex since shoulder 16 tapers into neck 14 for functionality of container 10. Further, the "square pyramid frustum" shape also includes edges 28 between triangular faces 26, and edges 30 between each triangular face 26 and the imaginary square base, as will be discussed further below. Edges 28, 30 may be rounded or substantially flat.

Shoulder 16 may have a height (from a bottom of neck 14 to a top of body 18) ranging from about 15 mm to about 50 mm, or about 20 mm, 25 mm, 30 mm, 35 mm, 40 mm, 45 mm, or the like. In an embodiment, shoulder 16 has a height that is about 35 mm. At a bottom portion (e.g., before body 18), shoulder 16 may have a width and a length ranging from about 40 mm to about 80 mm, or about 45 mm, 50 mm, 55 mm, 60 mm, 65 mm, 70 mm, 75 mm, or the like. In an embodiment, the width and the length of a bottom portion of shoulder 16 are the same and are about 60 mm. Alternatively, the width and the length of a bottom portion of shoulder 16 may be different.

As mentioned previously, containers of the present disclosure may be used to house carbonated liquids, or may be exposed to temperature and/or pressure changes during packaging, shipping, storage and/or retail display. Any of the above-described factors (e.g., carbonation, temperature changes, pressure changes, etc.) can contribute to the presence of an internal vacuum within sealed container 10 when container 10 houses a liquid. This is problematic for aesthetic reasons because triangular faces 26 can buckle, or sag, towards an interior of container 10. Sagging of this nature causes an unappealing aesthetic for container 10 that may be even further emphasized when container 10 includes an exterior label (not shown) (e.g., a sleeve, a sticker, shrink-wrap, plastic wrap, etc.) that covers at least a portion of triangular faces 26. In this regard, sagging of triangular faces 26 can pull them away from any exterior label, creating an undesirable aesthetic.

Additionally, when containers 10 are mass produced for retail distribution, they may be packaged, shipped, stored and/or displayed in a stacked position that exposes containers 10 to top-loading. Substantially square-shaped, or substantially rectangular-shaped containers, however, do not distribute load well and are susceptible to buckling under top-loading. Applicants have surprisingly found, however, that certain structural features can help to improve a container's performance when exposed to an internal vacuum, top-loading, or compressive forces.

One such feature is a cut-away portion 32 that may be included on each triangular face 26. As shown in FIGS. 1 and 2, cut-away portion 32 has a substantially oval-shaped panel 34 that is intersected by an interrupted, curved, horizontal rib 36 to divide panel 34 into to bean-shaped portions 34*a*, 34*b*. Curved, horizontal rib 36 is described as "interrupted" because it does not extend all the way around container 10 but is, instead, interrupted around container 10. Interrupted, curved, horizontal rib 36 follows the curves of bean-shaped portions 34*a*, 34*b* and, as such, curves in a vertical direction (i.e., upward and/or downward) along a side of container 10. The skilled artisan will appreciate, however, that the improved vacuum resistance is not dependent, for example, on the bean-shaped portions of cut-away portion 32, and that cut-away portion 32 may have any desired shape and/or size so long as cut-away portion 32 includes a panel that is intersected by a substantially horizontal rib. In this regard, cut-away portion 32 may include a circular panel that is intersected by a horizontal rib to create two, semi-circular shaped portions of the panel. Alternatively, cut-away portion 32 may include a square panel that is intersected by a horizontal rib to create two rectangular shaped portions of the panel. In a similar manner, interrupted, curved, horizontal rib 36 need not be curved, but may be substantially straight, sinusoidal, etc., so long as horizontal rib 36 is substantially in a horizontal plane.

Cut-away portion 32 may also extend a certain distance inward toward a center of container 10 (i.e., the depth of cut-away portion 32). For example, cut-away portion 32 may have a depth that ranges from about 0.5 to about 5 mm, or 1 mm, 1.5 mm, 2 mm, 2.5 mm, 3 mm, 3.5 mm, 4 mm, 4.5 mm, or the like. In an embodiment, cut-away portion 32 has a depth of about 1.5 mm. Similarly, interrupted, curved, horizontal rib 36 may have a height along a side of container 10 that ranges from about 0.5 to about 5 mm, or 1 mm, 1.5 mm, 2 mm, 2.5 mm, 3 mm, 3.5 mm, 4 mm, 4.5 mm, or the like. In an embodiment, interrupted, curved, horizontal rib 36 has a height of about 1.5 mm.

Figure 3:
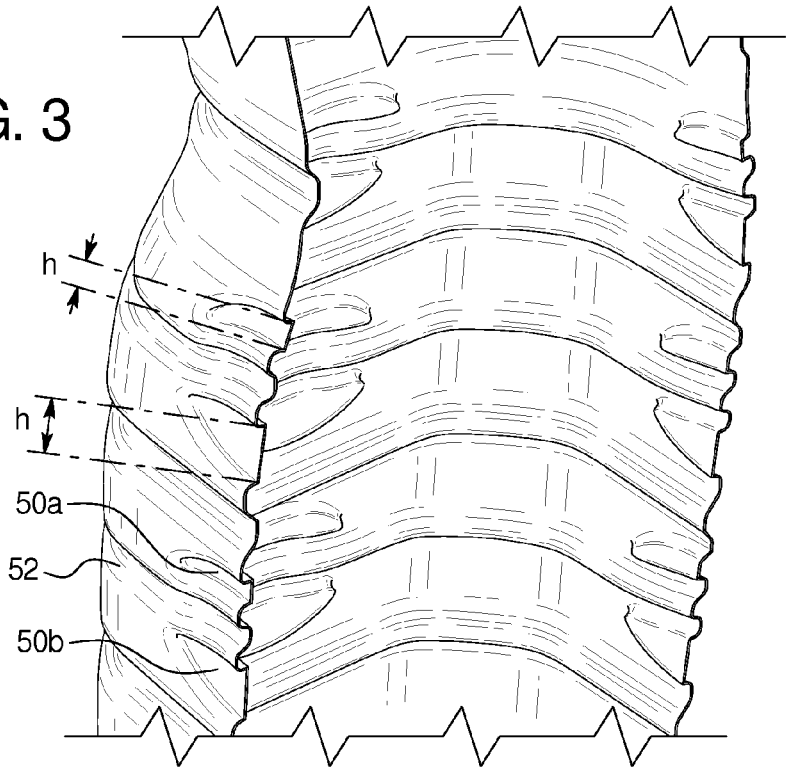
FIG. 3 shows a cut-away, cross-sectional view of the container of FIG. 2 in an embodiment of the present disclosure.

The bean-shaped portions of the panel may have the same or different heights a middle portion. In an embodiment, for example, as shown in FIG. 3, top bean-shaped portion 50*a* has a height ("h") of about 2.6 mm and bottom bean-shaped portion 50*b* has a height ("h") of about 6.3 mm. The skilled artisan will appreciate, however, that the bean-shaped portions may have a height ranging from about 1 mm to about 10 mm, or from about 2 mm to about 9 mm, or from about 3 mm to about 8 mm, or from about 4 mm to about 7 mm, or from about 5 mm to about 6 mm, or about 1.5, or 2.5, or 3.5, or 4.5, or 5.5, or 6.5, or 7.5, or 8.5, or 9.5, or the like.

Applicants have surprisingly found that providing cut-away portion 32 helps to resist any internal vacuum that may be created in container 10 during packaging, shipping, storage and/or retail display. Applicants performed various tests to determine the best possible shape and size of cut-away portion 32 to resist vacuum deformation and surprisingly concluded that the panel/rib feature provided improved resistance to vacuum deformation.

The skilled artisan will appreciate that, although a cut-away portion of the present disclosure is described herein as being "cut-away," the feature is not meant to be limited to formation by actually cutting material out of container 10. Instead, a "cut-away" portion is meant to describe an area of container 10 having a specific shape and a wall thickness that is less than the wall thickness of a surrounding portion of container 10. Accordingly, a cut-away portion of the present disclosure may be formed into a container preform during a blow-molding process, may be cut out of a container after formation of container 10, or may be formed by other known processes for creating such features. In an embodiment, a cut-away portion is formed into the container during blow-molding. In this regard, the decreased thickness of a cut-away portion is formed as a product of the greater stretching of the polymer resin that occurs near the edges of the cut-away portion during blow-molding. The skilled artisan will understand, then, that a mold used to form a plastic preform into a container having a cut-away portion includes a correspondingly-shaped projection that extends into an interior of the mold.

In an embodiment, cut-away portion 32 is located in a center of triangular face 26, as measured vertically and horizontally. The skilled artisan will appreciate, however, that cut-away portion 32 may be moved slightly higher, lower, left or right of the center of triangular face 16. Similarly, the cut-away portion 32 may be oriented in any direction including left, right, up, down, or combinations thereof. Cut-away portion 32 may have a height that comprises from about 10% to about 80% of a height of triangular face 16, or about 20%, 30%, 40%, 50%, 60%, 70%, or the like. Similarly, cut-away portion 32 may have a width that comprises from about 10% to about 80% of a width of triangular face 16, or about 20%, 30%, 40%, 50%, 60%, 70%, or the like.

Immediately below shoulder 16 is body 18 of container 10. Body 18 may have any size and shape known in the art and is not limited to a substantially square or substantially rectangular shape. For example, body 18 may have a shape selected from the group consisting of round, cylindrical, square, rectangular, ovoid, etc. In an embodiment, however, body 18 has a shape that is substantially square or substantially rectangular.

Similar to shoulder 16, body 18 of FIG. 1 may have edges 38 that are rounded if body 18 is substantially square or substantially rectangular in shape, as best shown in FIG. 1. Providing edges 38 that are rounded will help to improve the performance of the present containers when exposed to top-loading, or compressive forces. Alternatively, edges 38 may be substantially flat.

Body 18 may have any length, width or height known in the art. In this regard, body 18 may have a height ranging from about 50 mm to about 110 mm, or about 55 mm, 60 mm, 65 mm, 70 mm, 75 mm, 80 mm, 85 mm, 90 mm, 95 mm, 100 mm, 105 mm, or the like. In an embodiment, body 18 has a height of about 80 mm. If body 18 is substantially square-shaped or substantially rectangular-shaped with a specific length and width, the length and width may be the same. Alternatively, the width of body 18 may be different from the length of body 18. Even further, the length and width of body 18 may change with respect to the height of body 18. For example, and as shown in FIG. 1, body 18 may include at least a first portion 40 and a second portion 42, each portion having substantially flat, vertical portion 40*a*, 42*a*, and an inward-directed slope portion 40*b*, 42*b*, as measured with respect to a vertical, central axis of container 10. Inward-directed slope portions 40*b*, 42*b* may have an angle ranging from about 5° to about 45°, or about 10°, 15°, 20°, 25°, 30°, 35°, or the like. In an embodiment, inward-directed slope portions 40*b*, 42*b* have an angle of about 15°. Accordingly, as the height of container 10 increase or decreases, either or both of the length and width of body 18 may change as well. Such a configuration provides the added benefit of ease of handling and grip for the consumer. In this regard, the inward-directed slope portions 40*b*, 42*b* of body 18 meet at a tapered portion of body 18 that helps consumer to grip container 10 for ease of handling.

Further, inward-directed slope portions 40*b*, 42*b* have an increased draft that makes portions 40*b*, 42*b* taller and longer than similar beverage containers. As shown in FIG. 1, the tapered portion of body 18 where inward-directed sloped portions 40*b*, 42*b* of body 18 meet may also include a fully circumferential, horizontal rib 44 that also helps a consumer to grip container 10 for ease of handling. By "circumferential rib," it is meant that a rib (e.g., an indented or protruding elongated shape) extends all the way around container 10 in a substantially horizontal plane. Container 10 may have any number of circumferential ribs 44 and is not limited to just one. Circumferential rib 44 may also be located at any place along the height of body 18.

Circumferential rib 44 may have a height that ranges from about 0.5 to about 5 mm, or 1 mm, 1.5 mm, 2 mm, 2.5 mm, 3 mm, 3.5 mm, 4 mm, 4.5 mm, or the like. Circumferential rib 44 may also extend a certain amount into interior of container 10. For example, rib 44 may have a height in the vertical direction along body 18 of container 10 of about 0.5 to about 5 mm, or 1 mm, 1.5 mm, 2 mm, 2.5 mm, 3 mm, 3.5 mm, 4 mm, 4.5 mm, or the like. In an embodiment, rib 44 has a height of about 1.5 mm. Applicants have found that rib 44 can help to maintain an intended shape of container 10. For example, if container 10 has a substantially square-shape or a substantially-rectangular shape, rib 44 can help to limit container 10 from forming an oval shape during use. Rib 44 also enables even contraction of container 10 vertically, thereby allowing internal pressure to build within and enabling greater top-loading.

As a result of circumferential rib 44 and portions 40*b*, 42*b*, a middle section of container 10 will have a smaller diameter that provides improved gripping for the consumer. In this regard, the containers have optimized dimensions that allow for grip convenience, material stretching feasibility, and greater compression resistance than other portions of container 10. In this regard, a center portion of the containers includes a reduced cross-section that provides for at least two different handling possibilities: 1) a grip from the side section that gives full rigidity; and 2) a grip from the diagonal that gives flexible handling. Accordingly, the consumer can either feel a rigid grip or a flexible grip.

The configuration of container 10 at a center portion thereof also provides several additional advantages including, for example, the ability to apply a half-sleeve to container 10, noise-less grip when handling, easier pouring of the contents of container 10, and a stronger grip required to squeeze the bottle radially, which increases consumer trust in the structure of the bottle and reduces the chance of spillage. Additionally, the dimensions of the bottle (e.g., square-shaped, taller, thinner) allow the bottles to lay down in a storage position (e.g., on a retail shelf or in a refrigerator) to avoid cluttering of smaller storage spaces. Further, using less material to manufacture containers 10 (e.g., a reduction in mass from about 32 g to about 25 g) makes it easier to squeeze the bottles in the axial direction for recycling purposes.

In addition to the centrally-located circumferential rib 44, body 18 may also include any number of circumferential ribs 46 located on flat, vertical portions 40*a*, 42*a* of body 18. Body 18 may have any number of circumferential ribs 46 ranging, for example, from about 1 to about 10, or 2, 3, 4, 5, 6, 7, 8, 9, or the like. Circumferential ribs 46 may be adjacent each other in a vertical direction or may be adjacent a cut-away portion 48, or any combination thereof. Cut-away portion 48 is similar to cut-away portion 32 because it includes a substantially oval-shaped panel 50 that is intersected by a curved, horizontal rib 52 to divide panel 50 into to bean-shaped portions 50*a*, 50*b*. Curved, horizontal rib 52 follows the curves of bean-shaped portions 50*a*, 50*b* and, as such, curves in a vertical direction (i.e., upward and/or downward) along a side of container 10. The skilled artisan will appreciate that panel 50 of cut-away portion 48 may also have the same or different dimensions as panel 34 of cut-away portion 32. Cut-away portion 48 is different than cut-away portion 32 at least in that cut-away portion 48 does not include an interrupted horizontal rib 36, but rather a fully circumferential rib 52 that extends all the way around container 10, and possibly intersects other panels 50.

In an embodiment, a plurality of circumferential ribs 46 are provided, a plurality of cut-away portions 48 are provided, and the circumferential ribs 46 and cut-away portions 48 alternate in a vertical direction, as shown in FIG. 1. The skilled artisan will appreciate, however, that containers 10 are not limited to such a configuration, and that any number of circumferential ribs 46 or cut-away portions 48 may be provided and may be arranged in any combination thereof.

Container 10 can have a broad base 20 so as to be able to stand up when the container is completely filled, partially filled or empty. Base 20 can have any size or shape known in the art. However, in an embodiment, base 20 includes a size and shape corresponding to the size and shape of body 18. In this regard, if body 18 is substantially square-shaped with a specific length and width, base 20 may also be substantially square-shaped with the same length and width. Alternatively, the skilled artisan will appreciate that base 20 is not limited to the size and shape of body 18 and may have a different size and shape than body 18. Base 20 may have a height ranging from about 5 mm to about 45 mm, or about 10 mm, or 15 mm, or 20 mm, or 25 mm, or 30 mm, or 35 mm, or 40 mm, or the like. Base 20 may be substantially vertical in arrangement, or may be shaped (e.g., semi-circular), or may taper inward in an upward direction from a bottom surface 48 of container 10. Base 20 is shaped and configured to contract under vertical load, absorbing and distributing loads over a greater area.

Similar to body 18, base 20 may also include one or more circumferential ribs 46 that may or may not have the same size and shape as the circumferential ribs 46 provided on body 18. Further, a bottom surface 54 of container 10 may also include a punt 56 formed therein, as shown by FIG. 2. Punt 56 may provide additional structural integrity to container 10 and may aid in stacking containers 10 one on top of another.

The structural features (e.g., increased draft corners, reduced middle section circumference, cut-away portions, etc.) of the present containers described herein advantageously allow for a preform of less mass to be used. The reduced use of resin in the containers provides the advantage of a lower cost per unit and increased sustainability when compared to a bottle without such structural features. In this regard, the containers of the present disclosure are able to be manufactured using a raw material reduction from about 10% to about 25%, if not greater. Further, by manufacturing the containers of the present disclosure using lower amounts of raw materials, the bottles can provide lower environmental and waste impact. Along the same lines, the bottles can be constructed to use less disposal volume than other plastic bottles designed for similar uses.

Additionally, the containers of the present disclosure can also improve vacuum resistance and the ease of use and handling by manufacturers, retails and consumers. In this regard, the structural features described herein provide for reduced vacuum deformation to help achieve a pre-set shape of the containers that is desirable by consumers. Further, the containers have optimized dimensions that allow for grip convenience and material stretching feasibility. In this regard, a center portion of the containers includes a reduced cross-section that provides for at least two different handling possibilities: 1) a grip from the side section that gives full rigidity; and 2) a grip from the diagonal that gives flexible handling.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A plastic container comprising:

a mouth configured for liquid to be introduced into and removed from the container through the mouth; and a substantially rectangular-shaped body comprising a first cut-away portion on a first side of the body, the first cut-away portion having a first panel that is intersected by a first rib that extends along an outer perimeter of the container in a substantially horizontal plane, the first panel comprises two indentations formed on opposite sides of the first rib, the first rib comprises end portions on the substantially horizontal plane that intersect sides of the first panel and comprises a middle portion that varies in height from the substantially horizontal plane and is between the end portions, and the first rib curves in a vertical direction such that a vertical distance from the middle portion to the mouth is different than a vertical distance from the end portions to the mouth.

2. The container of claim 1, wherein the two indentations are complimentary shaped relative to each other.

3. The container of claim 1, wherein the two indentations are complimentary bean-shaped portions formed by the first rib.

4. The container of claim 1, wherein the first rib is one of an interrupted rib or a fully circumferential rib.

5. The container of claim 1, wherein the body comprises a second panel on a second side of the body, wherein the second panel is located in the same horizontal plane as the first panel.

6. The container of claim 1 comprising a shoulder between the mouth and the body, the shoulder comprising four faces arranged in a square pyramid frustum shape, at least one of the four faces comprising a second cut-away portion having a second panel intersected by a second rib that is an interrupted horizontal rib.

7. The container of claim 1, wherein the first side comprises a plurality of the cut-away portions.

8. The container of claim 1, wherein the container comprises a volume ranging from about 100 mL to about 5000 mL.

9. A plastic container comprising:

a neck defining a mouth of the container; and a body comprising a plurality of horizontal ribs extending along an outer perimeter of the container, each of the plurality of horizontal ribs is located in a different horizontal plane, the plurality of horizontal ribs comprises a first rib located intermediate two complimentary-shaped indentations, the first rib comprises end portions on the corresponding horizontal plane that intersect sides of the indentations and comprises a middle portion that varies in height from the substantially horizontal plane and is between the end portions, and the first rib curves in a vertical direction such that a vertical distance from the middle portion to the mouth is different than a vertical distance from the end portions to the mouth.

10. The container of claim 9, wherein each of the plurality of horizontal ribs fully extends around the circumference of the body.

11. The container of claim 9, wherein every other horizontal rib is located intermediate two complimentary-shaped indentations.

12. The container of claim 9, wherein the complimentary-shaped indentations are bean-shaped panels.

13. The container of claim 9, wherein the body comprises four sides, and each side comprises a plurality of horizontal ribs located intermediate two complimentary-shaped indentations.

14. The container of claim 9, wherein the body comprises at least one wall having first and second opposing inwardly-sloped portions forming an elongated middle section of the container.

15. The container of claim 14, wherein the elongated middle portion of the container has a reduced cross-section compared to vertical portions of the container.

16. The container of claim 14, wherein the first and second opposing inwardly-sloped portions meet at one of the horizontal ribs.

17. The container of claim 9 having a weight ranging from about 23 g to about 27 g.

18. A plastic container comprising:

a neck that defines a mouth of the container; and a substantially rectangular shaped body comprising a first plurality of horizontal ribs extending along an outer perimeter of the container, each rib of the first plurality of horizontal ribs is located in a different horizontal plane, and a second plurality of horizontal ribs extending along an outer perimeter of the container, each of the second plurality of horizontal ribs is located in a different horizontal plane and located intermediate two complimentary-shaped indentations, each of the first plurality of horizontal ribs alternates in a vertical direction with each of the second plurality of horizontal ribs, each of the second plurality of ribs comprises end portions on the corresponding horizontal plane that intersect sides of the indentations and comprises a middle portion that varies in height from the substantially horizontal plane and is between the end portions, and each of the second plurality of horizontal ribs curves in a vertical direction such that a vertical distance from the middle portion to the mouth is different than a vertical distance from the end portions to the mouth.

19. The container of claim 18, wherein each of the first plurality of horizontal ribs has a greater height than each of the second plurality of horizontal ribs.

20. The container of claim 9, comprising a first panel comprising the two complimentary-shaped indentations, and the end portions of the first rib intersect sides of the first panel in the same horizontal plane relative to each other.

* * * * *